US006213618B1

(12) United States Patent
Dobbin et al.

(10) Patent No.: US 6,213,618 B1
(45) Date of Patent: Apr. 10, 2001

(54) LIGHTING DEVICE CONVERTIBLE BETWEEN READING LIGHT AND PEN LIGHT CONFIGURATIONS AND HAVING SINGLE LIGHT ACTUATING SWITCH

(75) Inventors: Sarah Dobbin; Bjarki Hallgrimsson, both of Ottawa (CA); David Ball; Peter Altman, both of Austin, TX (US)

(73) Assignee: Lumatec Industries, Inc., Austin, TX (US)

( * ) Notice: Subject to any disclaimer, the term of this patent is extended or adjusted under 35 U.S.C. 154(b) by 0 days.

(21) Appl. No.: 09/451,176

(22) Filed: Nov. 30, 1999

(51) Int. Cl.[7] ..... F21V 33/00
(52) U.S. Cl. ..... 362/99; 362/199; 362/427
(58) Field of Search ..... 362/98, 99, 197, 362/287, 427, 199

(56) References Cited

U.S. PATENT DOCUMENTS

| | | | | |
|---|---|---|---|---|
| 4,432,042 | | 2/1984 | Zeller | 362/183 |
| 4,598,340 | | 7/1986 | Dwosh et al. | 362/98 |
| 4,680,681 | | 7/1987 | Fisherman et al. | 362/98 |
| 5,203,622 | | 4/1993 | Sottile | 362/109 |
| 5,280,416 | | 1/1994 | Hartley et al. | 362/98 |
| 5,442,528 | | 8/1995 | Vanderbelt | 362/98 |
| 5,695,271 | * | 12/1997 | Zeller | 362/98 |

OTHER PUBLICATIONS

Two Sheets Containing Color Photocopies Of Carton Showing Booklite By Centaur, No Date.

* cited by examiner

*Primary Examiner*—Stephen Husar
(74) *Attorney, Agent, or Firm*—John R. Flanagan; John K. Flanagan; Flanagan & Flanagan

(57) ABSTRACT

A lighting device convertible between reading light and pen light configurations uses only a single off/on light actuating switch in either configuration. The lighting device includes a main body, pivoting arm, hinge, light generating element, batteries and switch member and button. The main body has opposite front and rear ends and defines a recess at the front end. The pivoting arm has opposite front and rear ends. The hinge pivotally mounts the rear end of the pivoting arm to the rear end of the main body to allow pivotal movement of the pivoting arm between an erect position angularly spaced from the main body, the reading light configuration, and a lowered position adjacent to the main body, the pen light configuration. The light generating element is mounted to the pivoting arm adjacent to the front end thereof for providing light therebelow when the pivoting arm is in the erect position and is insertable within the recess of the main body and exposed only at the front end of the main body to provide light directly forwardly of the main body when the pivoting arm is in the lowered position. The batteries are mounted within the main body and electrically interconnected to the light generating element and switch member. The switch member and button are mounted to the main body for switching the light generating element between off and on states.

20 Claims, 3 Drawing Sheets

LIGHTING DEVICE CONVERTIBLE BETWEEN READING LIGHT AND PEN LIGHT CONFIGURATIONS AND HAVING SINGLE LIGHT ACTUATING SWITCH

CROSS REFERENCE TO RELATED APPLICATION

Reference is hereby made to a copending patent application entitled "Lighting Device Convertible Between Reading Light And Flashlight Configurations And Having Separate Light Actuating Switches" by Bjarki Hallgrimsson et al, U.S. Ser. No. 09/490,977, filed Jan. 24, 2000 and assigned to the same assignee as this application.

BACKGROUND OF THE INVENTION

1. Field of the Invention

The present invention generally relates to portable lighting devices and, more particularly, is concerned with a lighting device convertible between reading light and pen light configurations and having a single off/on light actuating switch.

2. Description of the Prior Art

Lighting devices variously configured as miniature flashlights and as book or reading lights are well known in the prior art. Examples of lighting devices which are configured as book or reading lights are disclosed in U.S. Pat. No. 4,432,042 to Zeller, U.S. Pat. No. 4,598,340 to Dwosh et al, U.S. Pat. No. 4,680,681 to Fisherman et al, U.S. Pat. No. 5,203,622 to Sottile, U.S. Pat. No. 5,280,416 to Hartley et al and U.S. Pat. No. 5,442,528 to Vandenbelt. A drawback of these and other prior art lighting devices is that their designs restrict them to a single type of use or purpose, either as a flashlight or as a reading light. They are configured to function as one or the other, not both. This requires consumers to purchase more than one lighting device for different functions or uses which results in higher cost to them and more devices which must be carried with them.

Consequently, a need exists for a lighting device having dual functionality or use, both as a flashlight and as a book or reading light, which will overcome the drawbacks of the prior art without introducing any new problems in place thereof.

SUMMARY OF THE INVENTION

The present invention provides a lighting device designed to satisfy the aforementioned need by being convertible between reading light (or book/magazine light) and pen light (or flashlight) configurations. Further, the convertible lighting device of the present invention has only a single off/on light actuating switch for the user to operate regardless of which configuration the lighting device is in. The convertible lighting device of the present invention reduces the number of devices that must be purchased and carried by consumers to serve these two functions or uses. This results in a more cost-effective and efficient approach in fulfilling the diverse lighting needs of consumers.

Accordingly, the present invention is directed to a convertible lighting device which comprises: (a) a main body having opposite front and rear ends; (b) a pivoting arm having opposite front and rear ends; (c) hinge means pivotally mounting the rear end of the pivoting arm to the rear end of the main body for allowing pivotal movement of the pivoting arm between an erect position angularly spaced from the main body and a lowered position adjacent to the main body; (d) illumination means mounted to the pivoting arm adjacent to the front end thereof for providing light therebelow when the pivoting arm is in the erect position and being exposed at the front end of the main body for providing light directly forwardly of the main body when the pivoting arm is in the lowered position; (e) means for supplying power to the illumination means being mounted to the main body and electrically connected to the illumination means; and (f) means mounted to the main body and connected to the power supplying means and illumination means for switching the illumination means between off and on states.

The main body has a recess at the front end in which the illumination means is inserted and exposed when the pivoting arm is in the lowered position. The main body also includes a base member and a top member. The base member has a bottom wall with opposite front and rear ends that defines a compartment in the base member and a first portion of the recess of the main body at the front end of the bottom wall. The top member has a top wall with opposite front and rear ends and is mounted on the base member and encloses the compartment of the base member. The top wall of the top member at the front end defines a second portion of the recess of the main body complementary to the first portion of the recess defined at the front end of the bottom wall of the base member such that the base and top members together define the recess of the main body.

The power supplying means includes one or more batteries. The base member of the main body has an opening defined in the bottom wall through which one or more batteries are inserted into and removed from the compartment within the base member of the main body. The device further comprises a compartment door attachable to and removable from the bottom wall of the base member of the main body for covering and uncovering the opening in the bottom wall. The device further comprises a compartment door locking member slidably mounted to and through an extension of the opening in the bottom wall of the base member of the main body adjacent to the compartment door. The slidable locking member is operable by being manually slid in one direction to engage with and prevent the compartment door from being removed from the bottom wall of the base member of the main body and by being manually slid in an opposite direction to disengage from and allow the compartment door to be removed from the bottom wall of the base member of the main body.

The base member of the main body also has a hole defined in the bottom wall. The switching means includes a switch member and a switch button mounted to the switch member. The switch member makes operable contact with one or more batteries of the power supplying means and the illumination means. The switch button is disposed through the hole of the bottom wall of the base member of the main body for a user to contact to move the switch member and the switch button together between first and second conditions such that the illumination means is thereby turned off and on.

The hinge means includes a plurality of aligned holes defined through the rear ends of the pivoting arm and main body, and a hinge pin fitted through the holes so as to pivotally couple the pivoting arm to the main body for undergoing the pivotal movement between the erect and lowered positions.

The illumination means includes a mounting element having opposite ends and being mounted at one of the opposite ends to the pivoting arm, and a light generating element mounted to the other of the opposite ends of the mounting element. The device further comprises a light reflecting shield hingedly attached to the pivoting arm adjacent to the illumination means such that the shield is pivotally movable between a retracted position in which the shield is disposed against the pivoting arm when the pivoting arm is in the lowered position and an extended position in which the shield partially surrounds the illumination means such that light provided by the illumination means is directed downwardly therefrom when the pivoting arm is in the erect position.

The device further comprises a clip mounted to the top wall of the top member of the main body. The pivoting arm has an opening for passage of the clip therethrough when the pivoting arm is moved to the lowered position.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description reference will be made to the attached drawings in which.

DETAILED DESCRIPTION OF THE INVENTION

Figure 1:
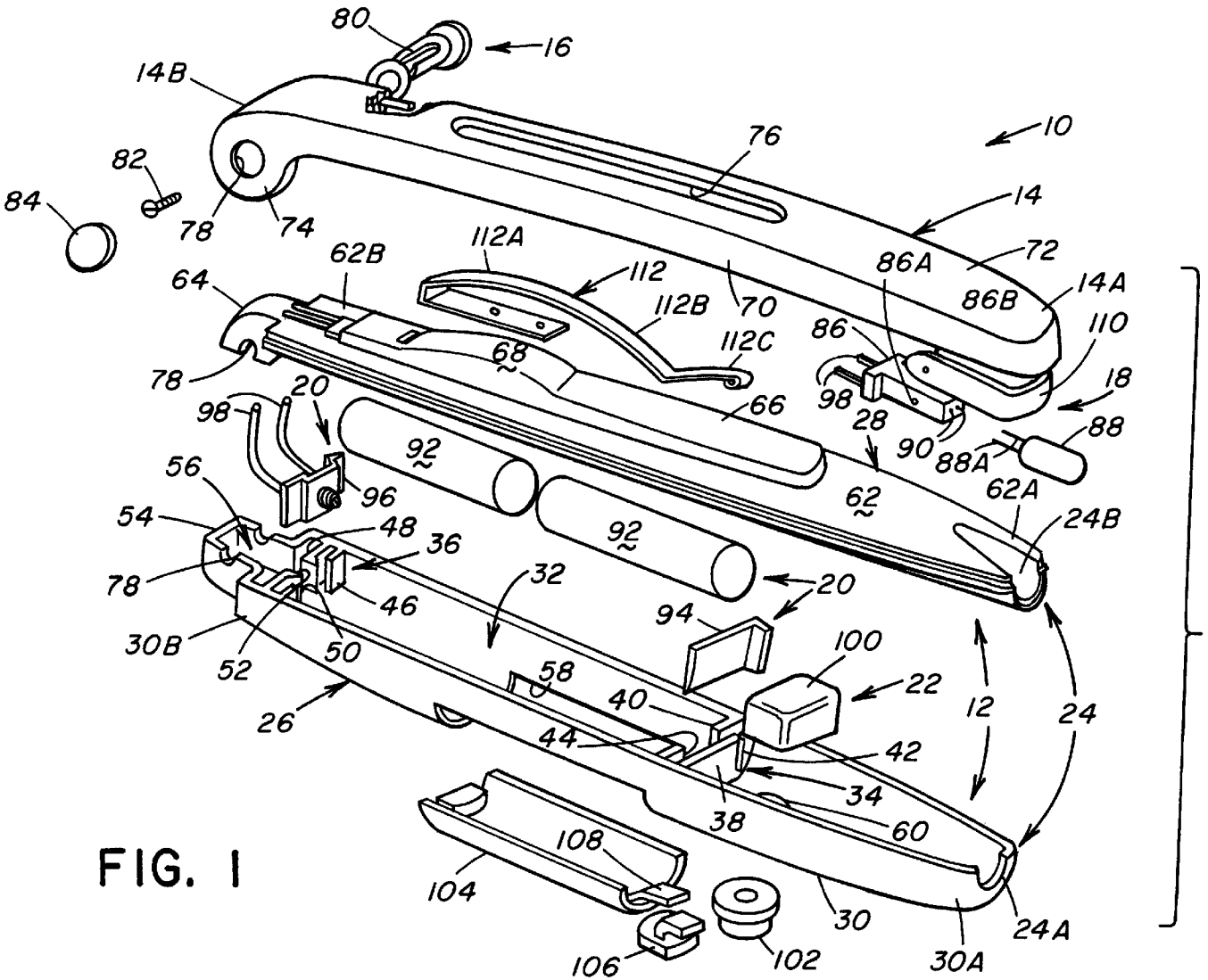
FIG. 1 is an exploded perspective view of a convertible lighting device of the present invention.
Figure 2:
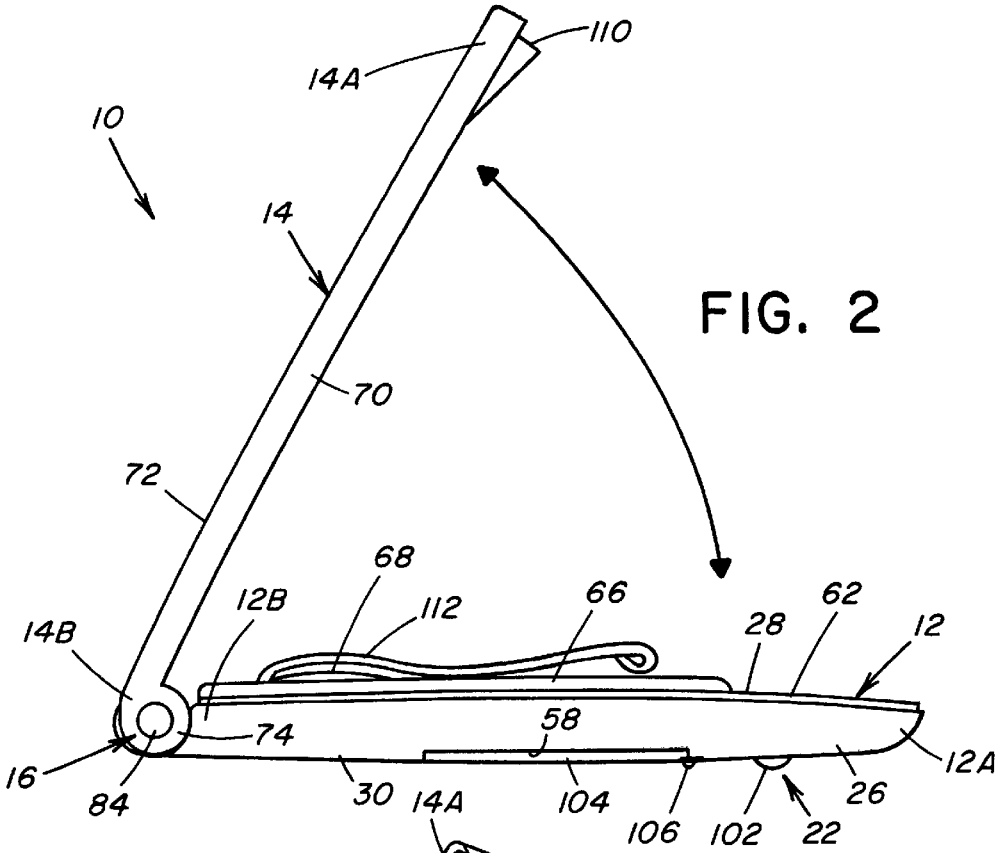
FIG. 2 is a side elevational view of the lighting device of FIG. 1 assembled and converted to a reading light configuration.
Figure 3:
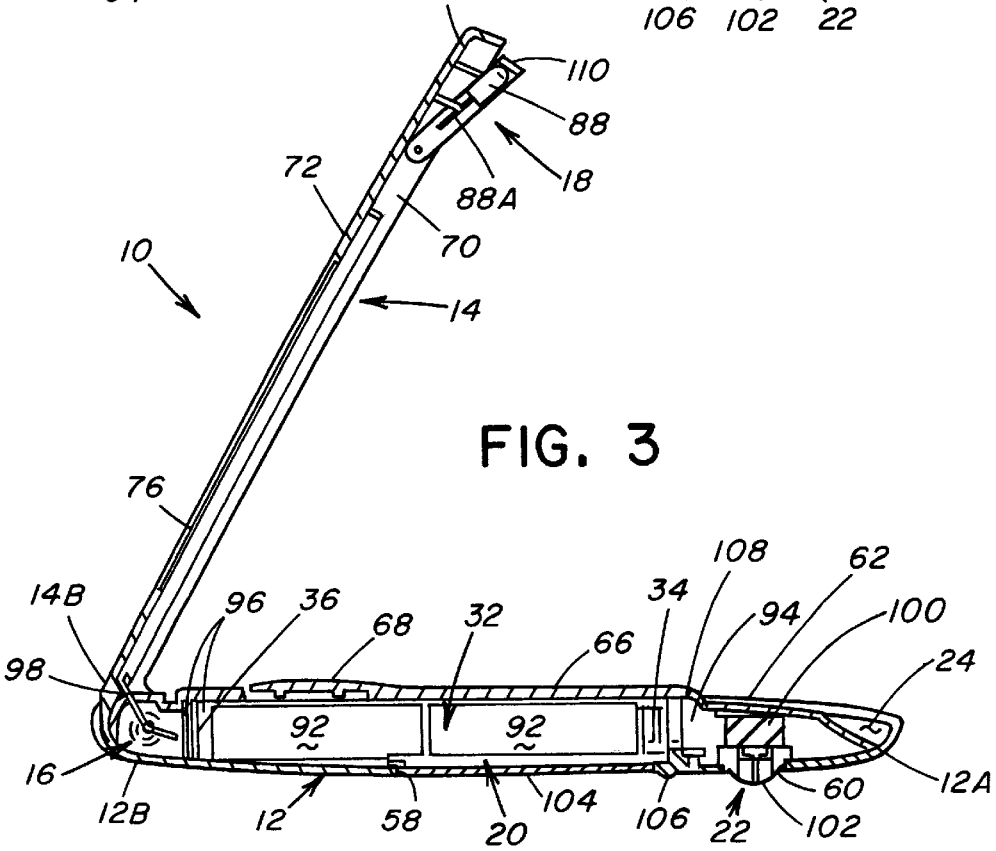
FIG. 3 is a longitudinal sectional view of the lighting device shown in FIG. 2.
Figure 5:
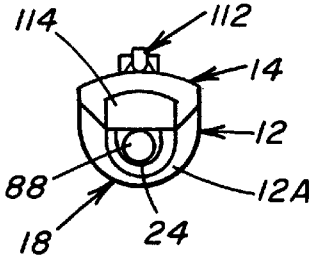
FIG. 5 is an end elevational view of the lighting device as seen along line 5—5 of FIG. 4.
Figure 7:
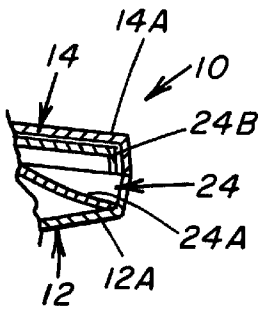
FIG. 7 is a fragmentary longitudinal sectional view of the lighting device taken along line 7—7 of FIG. 6.
Figure 4:
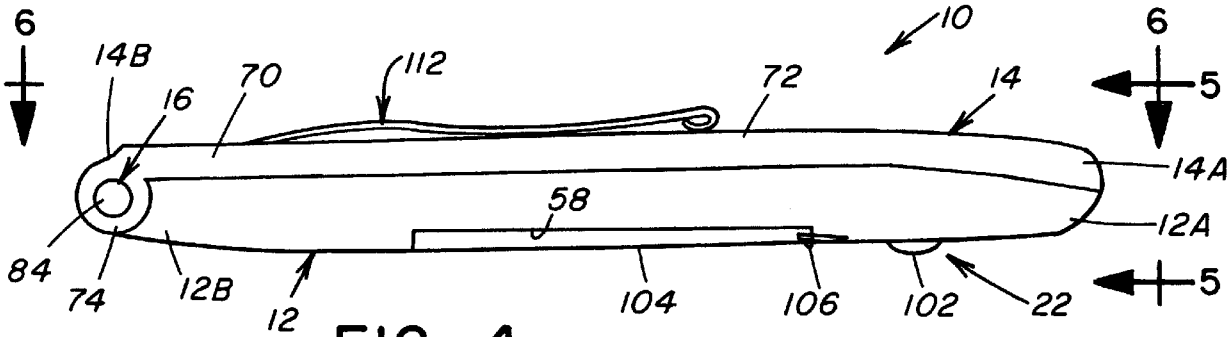
FIG. 4 is a side elevational view of the lighting device converted to a pen light configuration.
Figure 6:
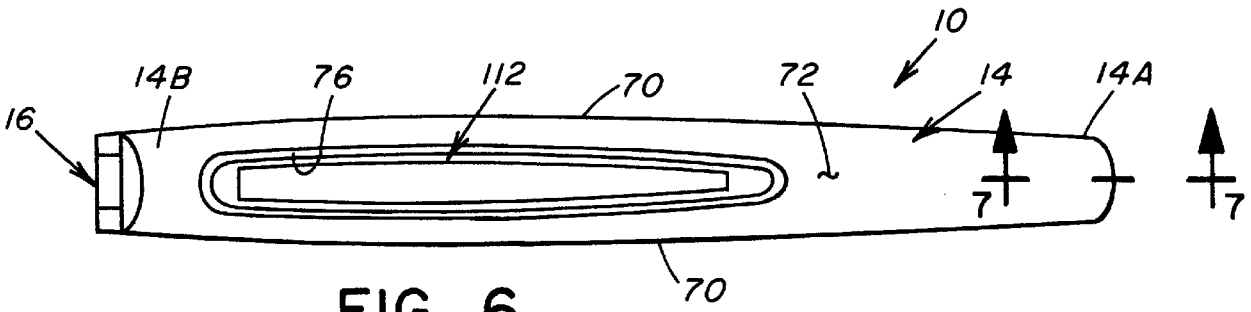
FIG. 6 is a top plan view of the lighting device as seen along line 6—6 of FIG. 4.

Referring to the drawings and particularly to FIGS. 1, 2 and 4, there is illustrated a convertible lighting device, generally designated 10, of the present invention being convertible between a reading light configuration, as shown in FIG. 2, and a pen light configuration, as shown in FIG. 4. Basically, the convertible lighting device 10 includes a main body 12, a pivoting arm 14, hinge means 16, illumination means 18, power supplying means 20 and switching means 22. The main body 12 has opposite front and rear ends 12A, 12B and defines a recess 24 at the front end 12A. The pivoting arm 14 has opposite front and rear ends 14A, 14B. The hinge means 16 pivotally mounts the rear end 14B of the pivoting arm 14 to the rear end 12B of the main body 12 for allowing pivotal movement of the pivoting arm 14 between a raised or erect position angularly spaced from the main body 12, being the reading light configuration of FIGS. 2 and 3, and a lowered position adjacent to the main body 12, being the pen light configuration of FIG. 4. The illumination means 18 is mounted to the pivoting arm 14 adjacent to the front end 14A thereof for providing light therebelow when the pivoting arm 14 is in the erect position of FIGS. 2 and 3 and being insertable within the recess 24 of the main body 12 and is exposed only at the front end 12A of the main body 12 for providing light directly forwardly of the main body 12 when the pivoting arm 14 is in the lowered position. The power supplying means 20 for powering the illumination means 18 is mounted to the main body 12 and electrically connected to the illumination means 18. The switching means 22 is mounted to the main body 12, connected to the power supplying means 20 and illumination means 18, and is actuatable for switching the illumination means 20 between off and on states.

Referring now to FIGS. 1 to 7, the main body 12 of the lighting device 10 includes a base member 26 and a cover or top member 28. The base member 26 of the main body 12 includes an elongated bottom wall 30 with opposite front and rear ends 30A, 30B providing the base member 26 with a substantially curved or semicylindrical configuration, though it may have any other suitable shape. The bottom wall 30 of the base member 26 tapers from the rear end 30B to the front end 30A. Also the base member 26 defines a compartment 32 therewithin and a first portion 24A of the recess 24 of the main body 12 at the front end 30A of the bottom wall 30. The compartment 32 extends substantially the entire length of the base member 26, though need not be so limited.

The base member 26 of the main body 12 further includes an intermediate partition 34 and a rear end partition 36 disposed within the compartment 32. The intermediate partition 34 is disposed closer to the front end 30A than to the rear end 30B of the bottom wall 30, though need not be so limited. The intermediate partition 34 is formed by a pair of spaced apart forward and rearward transverse walls 38, 40. The transverse walls 38, 40 are disposed in substantially parallel relation to one another, though need not be so limited. The forward transverse wall 38 defines a substantially vertical slot 42 closer to one end of the forward transverse wall 38 than to the other end thereof, though the vertical slot 42 may be defined in any other suitable location in the forward transverse wall 38. The rearward transverse wall 40 defines an opening 44 formed centrally therethrough or in any other suitable location in the rearward transverse wall 40. The vertical slot 42 and the opening 44 are out of alignment with one another. The rear end partition 36 is formed by a pair of spaced apart forward and rearward transverse walls 46, 48. The transverse walls 46, 48 are in substantially parallel relation to one another, though need not be so limited. The forward transverse wall 46 defines a forward opening 50 formed centrally therethrough or in any other suitable location in the forward transverse wall 46. The rearward transverse wall 48 defines a rearward opening 52 formed centrally therethrough or in any other suitable location in the rearward transverse wall 48. The forward opening 50 is wider than but aligned with the rearward opening 52.

The base member 26 of the main body 12 further includes a mounting portion 54 attached to and forming a continuation or extension of the rear end 30B of the bottom wall 30 of the base member 26. The mounting portion 54 defines a rear end cavity 56 in communication with the compartment 32 through openings 50, 52 in the transverse walls 46, 48 of the rear end partition 36. The rear end cavity 56 has a transverse width less than that of the compartment 32. The mounting portion 54 has a configuration substantially similar to but smaller than the bottom wall 30, though may have any other suitable shape. The first portion 24A of the recess 24 defined by the bottom wall 30 of the base member 26 has a semicircular configuration, though may have any other suitable shape.

The base member 26 of the main body 12 also has an opening 58 and a hole 60 defined in the bottom wall 30 thereof. The opening 58 is disposed in the bottom wall 30 symmetrically along a longitudinal centerline of the bottom wall 30 between the intermediate and rear end partitions 34, 36 of the base member 26 closer to the intermediate partition 34 than to the rear end partition 36, though need not be so limited. The opening 58 is a cutout of bottom wall 30 and so has a configuration substantially similar to the configuration of bottom wall 30 but appears to have a substantially rectangular configuration in a top plan view. The opening 58 leads into the compartment 32 and must be of a size large enough to fit one or more conventional AAA batteries therethrough, though may otherwise have any other suitable shape and size. The hole 60 is disposed symmetrically along the centerline of the bottom wall 30 between the intermediate partition 34 of the base member 26 and the front end 30A of the bottom wall 30 closer to the intermediate partition 34 than to the front end 30A, though need not be so limited. The hole 60 has a substantially circular configuration, though may have any other suitable shape. The hole 60 is substantially smaller in size than the opening 58, though need not be so limited.

The top member 28 of the main body 12 includes an elongated top wall 62 with opposite front and rear ends 62A, 62B. The top wall 62 is fixedly mounted upon the base member 26 so as to overlie and enclose the compartment 32 of the base member 26. The top wall 62 at the front end 62A thereof defines a second portion 24B of the recess 24 of the main body 12 at the front end 28A complementary to the first portion 24A of the recess 24 defined by the front end 30A of the bottom wall 30 of the base member 26 such that the base and top members 26, 28 together define the recess 24 of the main body 12. The top wall 62 has a substantially flat configuration, though may have any other suitable shape.

The top member 28 of the main body 12 also includes a mounting portion 64 at the rear end 62B of the top wall 62 thereof. The mounting portion 64 attached to and forming an extension or continuation of the top wall 62 substantially complements the mounting portion 54 of the base member 26 and encloses the rear end cavity 56 of the base member 26. The top wall 62 has a relief portion 66 formed thereon which is disposed closer to the rear end 62B than to the front end 62A thereof, though need not be so limited. The relief portion 66 is elongated and has opposite ends spaced inwardly from the front and rear ends 62A, 62B of the top wall 62 and has a hump 68 formed closer to the rear end 62B than to the front end 62A of the top wall 62. The second portion 24B of the recess 24 defined by the top wall 62 has a substantially semilunar configuration which converges rearwardly from the front end 62A to a point spaced rearwardly from the front end 62A of the top wall 62, though may have any other suitable shape.

The pivoting arm 14 of the lighting device 10 has elongated opposite side walls 70 which are continuous with one another around the front end 14A of the pivoting arm 14, an elongated top wall 72 extending between and interconnecting the opposite side walls 70, and a pair of opposite tabs 74 formed on the opposite side walls 70 at the rear end 14B of the pivoting arm 14. The top wall 72 has a substantially flat configuration, though may have any other suitable shape. The pivoting arm 14 tapers from the rear end 14B to the front end 14A thereof and has a length and a width substantially the same as the length and the width of the main body 12. The pivoting arm 14 has an opening 76 disposed centrally through the top wall 72 such that when the pivoting arm 14 is in the lowered position the opening 76 is disposed over part of the relief portion 66, including the hump 68, of the top member 28 of the main body 12. The opening 76 has a substantially oblong configuration, though may have any other suitable shape, and has a size smaller than that of the relief portion 66 of the top member 28.

The hinge means 16 of the lighting device 10 includes a plurality of aligned holes 78 and a hinge pin 80. The holes 78 are four in number, though may be of any other suitable number. A pair of the holes 78 are defined at the rear end 14B of the pivoting arm 14 through the opposite tabs 74 thereon and another pair of the holes 78 are defined at the rear end 12B of the main body 12 through the opposite sides of the mounting portions 54, 64 of the base and top members 26, 28 thereof. The holes 78 have substantially circular configurations and receive the hinge pin 80 of similar configuration therethrough. The hinge pin 80 is fitted through the holes 78 and through the rear end cavity 56 of the base member 26 of the main body 12 and is retained therethrough by a screw 82 on a cover 84 so as to pivotally mount the pivoting arm 14 to the main body 12 permitting the pivoting arm 14 to undergo the pivotal movement between the erect and lowered positions.

The illumination means 18 of the lighting device 10 includes a mounting element 86 and a light generating element 88. The mounting element 86 is mounted at holes 86A on opposite sides 86B thereof to the pivoting arm 14 adjacent to the front end 14A thereof and under the top wall 72 and between the opposite sides 70 thereof. The light generating element 88 is mounted to holes 90 in the front end of the mounting element 86. The light generating element 88 may be of any conventional type and may have a lens focusing element for concentrating the light beam generated by the light generating element 88. The light generating element 88 has a pair of leads 88A inserted into the holes 90 formed in the front end of the mounting element 86. The light generating element 88 is the portion of the illumination means 18 that inserts into the recess 24 of the main body 12 when the pivoting arm 14 is pivoted to the lower position.

The power supplying means 20 of the lighting device 10 includes at least one and, preferably, a pair of batteries 92. Each battery 92 is preferably of the AAA type, but the lighting device 10 could be designed to use any other suitable type of battery. The batteries 92 are insertable into and removable from within the compartment 32 through the opening 58 in the bottom wall 30 of base member 26 of main body 12.

The power supplying means 20 of the lighting device 10 further includes elements required for providing an electrical circuit for making an electrical connection between the illumination means 18, batteries 92 and switching means 22. These elements include a first contact plate 94, second contact plate 96 and electrical conductors 98 made of electrically conductive material. The first contact plate 94 has a substantially L-shaped configuration, though need not be so limited, and is mounted between the forward and rearward transverse walls 38, 40 and through the vertical slot 42 of the forward transverse wall 38 of the intermediate partition 34 within the compartment 32 of the base member 26 of the main body 12. The second contact plate 96 has a substantially U-shaped configuration, though need not be so limited, and is mounted between the forward and rearward transverse walls 46, 48 and through the forward opening 50 of the forward transverse wall 46 of the rear end partition 36 within the compartment 32 of the base member 26 of the main body 12. The batteries 92 are disposed end-to-end between the first and second contact plates 94, 96 such that an end of one battery 92 contacts the first contact plate 94 and an end of the other battery 92 contacts the second contact plate 96.

The switching means 22 of the lighting device 10 includes a switch member 100 and a switch button 102 mounted to the switch member 100. The switch member 100 is mounted by the bottom wall 30 of the base member 26 to make operable contact with the first contact member 94 of the power supplying means 20. The switch button 102 is disposed through the hole 60 of the bottom wall 30 of the base member 26 of the main body 12 for a user to manually contact to move the switch member 100 and the switch button 102 together between first and second conditions. The electrical conductors 98 of the power supplying means 20 (only being partially shown) are mounted along the underside of the top wall 72 of the pivoting arm 14 adjacent to the opposite side walls 70 thereof so as to extend and connect at one ends to the mounting element 86 of the illumination means 18, and also are mounted along the bottom wall 30 through the compartment 32 so as to extend and connect at opposite ends to the second contact plate 96 and switch member 100. The electrical conductors 98 thereby form the electrical circuit with the light generating element 88, batteries 92, first and second contact members 94, 96 and switch member 100 such that by switching the switch member 100 between the first and second conditions the light generating element 88 is thereby turned off and on. In the first condition, the switch member 100 does not make electrical contact with the first contact plate 94 and thus interrupts the electrical circuit such that the light generating element 88 is not turned on. In the second condition, the switch member 100 makes electrical contact with the second contact plate 96 and thus makes the electrical circuit such that the light generating element 88 is turned on.

The lighting device 10 further includes a compartment door 104 and a compartment door locking member 106. The compartment door 104 is movably mounted to the bottom wall 30 of the base member 26 of the main body 12 for covering and uncovering the opening 58 in the bottom wall 30. The compartment door 104 has a configuration which is similar to and a continuation of the bottom wall 30 of the base member 26, though it may have any other suitable shape. The compartment door 104 has a tongue member 108 extending from one end of the door 104.

The compartment door locking member 106 is slidably mounted to and through the opening 58 of the bottom wall 30 of the base member 26 of the main body 12 adjacent to the end of the compartment door 104 where the tongue member 108 is located such that sliding movement of the locking member 106 in one direction causes the locking member 106 to overlap an edge of the compartment door 104 preventing it from being removed from the bottom wall 30 of the base member 26 of the main body 12 whereas sliding movement of the locking member 106 in an opposite direction clears the locking member 106 from overlapping the compartment door 104 allowing it to be removed from the bottom wall 30. An outer portion 106A of the locking member 106 is contacted by a user outside the compartment 32 for manually sliding the locking member 106.

The lighting device 10 further includes a light reflecting shield 110 hingedly attached to the pivoting arm 14 at its forward end 14A and adjacent to the illumination means 18 such that the shield 110 is pivotally movable between a retracted position in which the shield 110 is disposed against the pivoting arm 14 when the pivoting arm 14 is in the lowered position and an extended position in which the shield 110 partially surrounds the illumination means 18 such that light provided by the illumination means 18 is directed downwardly therefrom when the pivoting arm 14 is in the erect position. The light reflecting shield 110 has a substantially U-shaped configuration, though may have any other suitable shape, and generally conforms to the shape of the front end 14A of the pivoting arm 14. The light reflecting shield 110 is positioned such that a round intermediate front portion 110A of the U-shape is directed forwardly and such that opposite ends 110B of the U-shape are directed rearwardly along the opposite sides 86B of the mounting element 86. The light reflecting shield 110 has holes 110C at its opposite ends 110B where the shield 110 together with the mounting element 86 at the holes 86A on the opposite sides 86B are hingedly attached to and between the opposite side walls 70 of the arm 14.

The lighting device 10 further includes a clip 112 mounted to the top wall 62 of the top member 28 of the main body 12. The clip 112 is particularly mounted to the relief portion 66 of the top member 28 of the main body 12. The clip 112 has an upper curved portion 112A and a lower straight portion 112B bent under the upper curved portion 112A. The lower straight portion 112B is particularly mounted to the hump 68 of the relief portion 66. The upper curved portion 112A has a length substantially greater than the length of the lower straight portion 112B. The clip 108 further has an inclined end portion 112C angled away from the relief portion 66. The clip 112 is moved through the opening 76 of the top wall 72 of the pivoting arm 14 when the latter is moved to the lowered position so as to be exposed for use in temporarily attaching the lighting device 10 to the user's clothing when worn in a clothing pocket. The clip 112 also can be used as a book light clip when the arm 14 is in the erect position.

It is thought that the present invention and many of its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A convertible lighting device, comprising:

(a) a main body having opposite front and rear ends;

(b) a pivoting arm having opposite front and rear ends;

(c) hinge means pivotally mounting said rear end of said pivoting arm to said rear end of said main body for allowing pivotal movement of said pivoting arm between an erect position angularly spaced from said main body and a lowered position adjacent to said main body;

(d) illumination means mounted to said pivoting arm adjacent to said front end thereof for providing light therebelow when said pivoting arm is in said erect position and being exposed at said front end of said main body for providing light directly forwardly of said main body when said pivoting arm is in said lowered position;

(e) means for supplying power to said illumination means being mounted to said main body and electrically connected to said illumination means; and (f) means mounted to said main body and connected to said power supplying means and said illumination means for switching said illumination means between off and on states.

2. The device of claim 1 wherein said main body has a recess at said front end thereof in which said illumination means is inserted and exposed when said pivoting arm is in said lowered position, said main body including:

a base member having a bottom wall with opposite front and rear ends that defines a compartment in said base member and a first portion of said recess of said main body; and a top member having a top wall with opposite front and rear ends and being mounted on said base member and enclosing said compartment of said base member, said top wall at said front end defining a second portion of said recess of said main body complementary to said first portion of said recess such that said base and top members together define said recess of said main body.

3. The device of claim 2 wherein said base member of said main body has an opening defined in said bottom wall leading into said compartment in said base member.

4. The device of claim 3 further comprising:

a compartment door movably mounted to said bottom wall of said base member of said main body for covering and uncovering said opening in said bottom wall.

5. The device of claim 4 further comprising:

a compartment door locking member slidably mounted to and through an extension of said opening in said bottom wall of said base member of said main body adjacent to said compartment door and being operable therewith such that movement of said compartment door locking member in one direction prevents said compartment door from being removed from said bottom wall of said base member of said main body whereas movement of said compartment door locking member in an opposite direction allows said compartment door to be removed from said bottom wall of said base member of said main body.

6. The device of claim 2 wherein:

said base member of said main body has a hole defined in said bottom wall; and said switching means includes a switch member and a switch button mounted to said switch member, said switch member making operable contact with said power supplying means and said switch button being disposed through said hole in said bottom wall of said base member of said main body for a user to contact to move said switch member and said switch button together between first and second conditions such that said illumination means is thereby turned off and on.

7. The device of claim 1 wherein said hinge means includes:

a plurality of aligned holes defined through said rear ends of said pivoting arm and main body; and a hinge pin fitted through said holes so as to pivotally couple said pivoting arm to said main body for undergoing the pivotal movement between said erect and lowered positions.

8. The device of claim 1 wherein said illumination means includes:

a mounting element having opposite ends and being mounted at one of said opposite ends to said pivoting arm; and a light generating element mounted to the other of said opposite ends of said mounting element.

9. The device of claim 8 further comprising:

a light reflecting shield hingedly attached to said pivoting arm adjacent to said light element such that said light reflecting shield is pivotally movable between a retracted position in which said light reflecting shield is disposed against said pivoting arm when said pivoting arm is in said lowered position and an extended position in which said light reflecting shield partially surrounds said light generating element such that light provided by said light generating element is directed downwardly therefrom when said pivoting arm is in said erect position.

10. The device of claim 1 wherein said power supplying means includes at least one battery.

11. The device of claim 1 further comprising:

a clip mounted to said main body and protruding therefrom and adapted for use as a pocket clip when said pivoting arm is in said lowered position and as a book light clip when said pivoting arm is in said erect position.

12. The device of claim 11 wherein said pivoting arm has an opening for passage of said clip therethrough when said pivoting arm is moved to said lowered position.

13. The device of claim 1 further comprising:

a light reflecting shield hingedly attached to said pivoting arm adjacent to said illumination means such that said light reflecting shield is pivotally movable between a retracted position in which said light reflecting shield is disposed against said pivoting arm when said pivoting arm is in said lowered position and an extended position in which said light reflecting shield partially surrounds said illumination means such that light provided by said illumination means is directed downwardly therefrom when said pivoting arm is in said erect position.

14. A convertible lighting device, comprising:

(a) a main body having opposite front and rear ends and a recess defined at said front end, said main body including (i) a base member having a bottom wall with opposite front and rear ends that defines a compartment in said base member, an opening in said bottom wall leading into said compartment, and a hole in said bottom wall, and (ii) a top member having a top wall with opposite front and rear ends and being mounted on said base member and enclosing said compartment of said base member;

(b) a compartment door movably mounted to said bottom wall of said base member of said main body for covering and uncovering said opening in said bottom wall;

(c) a clip mounted to said top wall of said top member of said main body;

(d) a pivoting arm having opposite front and rear ends and an opening defined therein between said front and rear ends;

(e) hinge means pivotally mounting said rear end of said pivoting arm to said rear end of said main body for allowing pivotal movement of said pivoting arm between an erect position angularly spaced from said main body and a lowered position adjacent to said main body, said clip passing through said opening in said pivoting arm when said pivoting arm is moved to said lowered position, said clip being adapted for use as a pocket clip when said pivoting arm is in said lowered position and as a book light clip when said pivoting arm is in said erect position;

(f) illumination means mounted to said pivoting arm adjacent to said front end thereof for providing light therebelow when said pivoting arm is in said erect position and being insertable within said recess of said main body and exposed only at said front end of said main body for providing light directly forwardly of said main body when said pivoting arm is in said lowered position;

(g) means for supplying power to said illumination means being mounted to said main body and electrically interconnected to said illumination means; and (h) means mounted to said main body and connected to said power supplying means and illumination means for switching said illumination means between off and on states.

15. The device of claim 14 wherein:

said base member at said front end of said bottom wall thereof defines a first portion of a recess defined in said front end of said main body for receiving said light element therein when said pivoting arm is in said lowered position; and said top member at said front end of said top wall thereof defines a second portion of said recess of said main body complementary to said first portion of said recess defined at said front end of said bottom wall of said base member such that said base and top members together define said recess of said main body.

16. The device of claim 14 further comprising:

a compartment door locking member slidably mounted to and through an extension of said opening in said bottom wall of said base member of said main body adjacent to said compartment door and being operable therewith such that movement of said compartment door locking member in one direction prevents said compartment door from being removed from said bottom wall of said base member of said main body whereas movement of said compartment door locking member in an opposite direction allows said compartment door to be removed from said bottom wall of said base member of said main body.

17. The device of claim 14 wherein said switching means includes a switch member and a switch button mounted to said switch member, said switch member making operable contact with said power supplying means and said switch button being disposed through said hole in said bottom wall of said base member of said main body for a user to contact to switch said switch member and said switch button together between first and second conditions such that said illumination means is thereby turned off and on.

18. The device of claim 14 wherein said hinge means includes:

a plurality of aligned holes defined through said rear ends of said pivoting arm and said rear end of said main body; and a hinge pin fitted through said holes so as to pivotally couple said pivoting arm to said main body for undergoing the pivotal movement between said erect and lowered positions.

19. The device of claim 14 wherein said illumination means includes:

a mounting element having opposite ends and being mounted at one of said opposite ends to said pivoting arm; and a light generating element mounted to the other of said opposite ends of said mounting element.

20. The device of claim 19 further comprising:

a light reflecting shield hingedly attached to said pivoting arm adjacent to said light generating element such that said light reflecting shield is pivotally movable between a retracted position in which said light reflecting shield is disposed against said pivoting arm when said pivoting arm is in said lowered position and an extended position in which said light reflecting shield partially surrounds said light generating element such that light provided by said light generating element is directed downwardly therefrom when said pivoting arm is in said erect position.

* * * * *